US006970669B2

(12) United States Patent
Mishra et al.

(10) Patent No.: US 6,970,669 B2
(45) Date of Patent: Nov. 29, 2005

(54) CONTINUOUS FLEXIBLE BELT LOADING DEVICE

(75) Inventors: Satchidanand Mishra, Webster, NY (US); Satish R. Parikh, Rochester, NY (US); Robert C. U. Yu, Webster, NY (US); Edward A. Domm, Hilton, NY (US)

(73) Assignee: Xerox Corporation, Stamford, CT (US)

( * ) Notice: Subject to any disclaimer, the term of this patent is extended or adjusted under 35 U.S.C. 154(b) by 113 days.

(21) Appl. No.: 10/719,397

(22) Filed: Nov. 21, 2003

(65) Prior Publication Data

US 2005/0111878 A1 May 26, 2005

(51) Int. Cl.[7] ..... G03G 15/02; G03G 15/00
(52) U.S. Cl. ..... 399/116; 399/162
(58) Field of Search ..... 399/107, 110, 116, 399/159, 162; 206/303, 493, 316.1

(56) References Cited

U.S. PATENT DOCUMENTS 5,282,345 A * 2/1994 Darcy et al. ..... 53/118
5,708,924 A * 1/1998 Shogren et al. ..... 399/116
5,960,243 A 9/1999 Daigo et al.
5,978,625 A * 11/1999 Park ..... 399/116
6,049,682 A 4/2000 Goetzke et al.
6,097,912 A 8/2000 Watson et al.
6,185,395 B1 * 2/2001 Lee ..... 399/116
6,304,737 B1 10/2001 Dotschkal ..... 399/117
6,356,725 B1 * 3/2002 Park et al. ..... 399/116
6,393,236 B1 * 5/2002 Yamamoto ..... 399/116

* cited by examiner

*Primary Examiner*—Sandra L. Brase
(74) *Attorney, Agent, or Firm*—Tallam I. Nguti

(57) ABSTRACT

A belt loading apparatus has been provided for loading a flimsy continuous belt onto a belt support and drive assembly including a vertical front end having a first shape and without damage to the belt. The belt loading apparatus includes a wall member defining a sleeve including an outer surface having a total outer surface area, a first edge and a second and opposite edge. The second edge has a vertical profile having a second shape such that the second shape of the second edge is a mirror image of the first shape of the belt support and drive assembly. The belt loading apparatus then includes friction reducing members formed on the outer surface of the sleeve for temporarily supporting and spacing a flimsy continuous belt to be loaded onto the belt support and drive assembly. The friction reducing members each have a belt contact area such that a sum total of belt contact areas of all the friction reducing members is significantly less than the total outer surface area of the sleeve.

25 Claims, 9 Drawing Sheets

CONTINUOUS FLEXIBLE BELT LOADING DEVICE

This invention relates generally to a reprographic printing machine, and more particularly, to a system in a such as a machine for easily mounting and positioning a large continuous flexible belt, such as a photoreceptor belt, onto the belt support and drive assembly or belt module for such a belt. Specifically, this invention relates to a simple, fast and easy apparatus for mounting and positioning a flexible type photoreceptor belt onto the belt support and drive assembly for the photoreceptor belt in a xerographic printing machine, and in a manner that substantially prevents damage to edges of the photoreceptor belt.

In reprographic apparatus, a large belt photoreceptor, such a multiple layered photoreceptor belt, is used; but the belt has a large circumference, a low rigidity, and excessive flexibility. As a consequence, the belt is unwieldy for one person to handle safely without causing some creases and denting damages in any attempts to load it onto a belt module. Any such damages of course will result in image quality defects on printed copies.

The belt support and drive assembly in reprographic machines that use such large belts is typically constructed with multiple components whose edges present obstacles to simply and easily sliding the photoreceptor belt onto the belt support and drive assembly. Ordinarily, the edges of a multiple layered photoreceptor belt tend to curl inwardly, thereby catching on the machine hardware and creating kinks in the imaging area of the photoreceptor belt.

To alleviate this problem, it is known as disclosed for example in commonly owned U.S. Pat. No. 6,304,737 issued Oct. 16, 2001 to Dotschkal (pertinent portions of which are incorporated herein by reference), to pre-position a removable smooth covering boot over the drive and support system or belt module, and then mounting the photoreceptor belt over the boot. After such mounting, the boot is then removed leaving the photoreceptor on the drive and support system.

It has been found that where the photoreceptor belt is very long, for example a 10-pitch or 10 image frames belt, it is nearly impossible to mount it onto the belt support and drive assembly or belt module without causing wrinkles or without touching parts of it against components of the drive and support assembly. The belt module for such a belt itself is usually a huge assembly of many elements that leave very little room for mounting the photoreceptor belt into its place. Where such a belt module has a unique shape, it is additionally necessary for the photoreceptor belt to be pre-shaped to the shape of the module before attempts are made to mount it onto the module.

Additionally, it has been found that during the process of removing the smooth boot after using it as above to mount the photoreceptor to the module, the two then to stick together due to friction and electrostatic forces, thus making it difficult to separate the smooth boot from the photoreceptor and risking damage to the photoconductive characteristics of the photoreceptor belt.

There is therefore a need for a simple, fast and easy apparatus for mounting and positioning a flexible continuous belt such as photoreceptor belt onto the belt support and drive module in a manner that substantially reduces friction and prevents electrostatic damage to the photoreceptor belt.

The present invention provides a belt loading apparatus for loading a flimsy continuous belt onto a belt support and drive assembly including a vertical front end having a first shape and without damage to the belt. The belt loading apparatus includes a wall member defining a sleeve including an outer surface having a total outer surface area, a first edge and a second and opposite edge. The second edge has a vertical profile having a second shape such that the second shape of the second edge is a mirror image of the first shape of the belt support and drive assembly. The belt loading apparatus then includes friction reducing members formed on the outer surface of the sleeve for temporarily supporting and spacing from the outer surface a flimsy continuous belt to be loaded onto the belt support and drive assembly. The friction reducing members each have a belt contact area such that a sum total of belt contact areas of all the friction reducing members is significantly less than the total outer surface area of the sleeve.

BRIEF DESCRIPTION OF THE DRAWINGS

In the detailed description of the invention presented below, reference is made to the drawings in which.

DETAILED DESCRIPTION OF THE INVENTION

While the present invention will be described hereinafter in connection with a preferred embodiment thereof, it should be understood that it is not intended to limit the invention to that embodiment. On the contrary, it is intended to cover all alternative, modifications and equivalents as may be included within the spirit and scope of the invention as defined by the appended claims.

Figure 1:
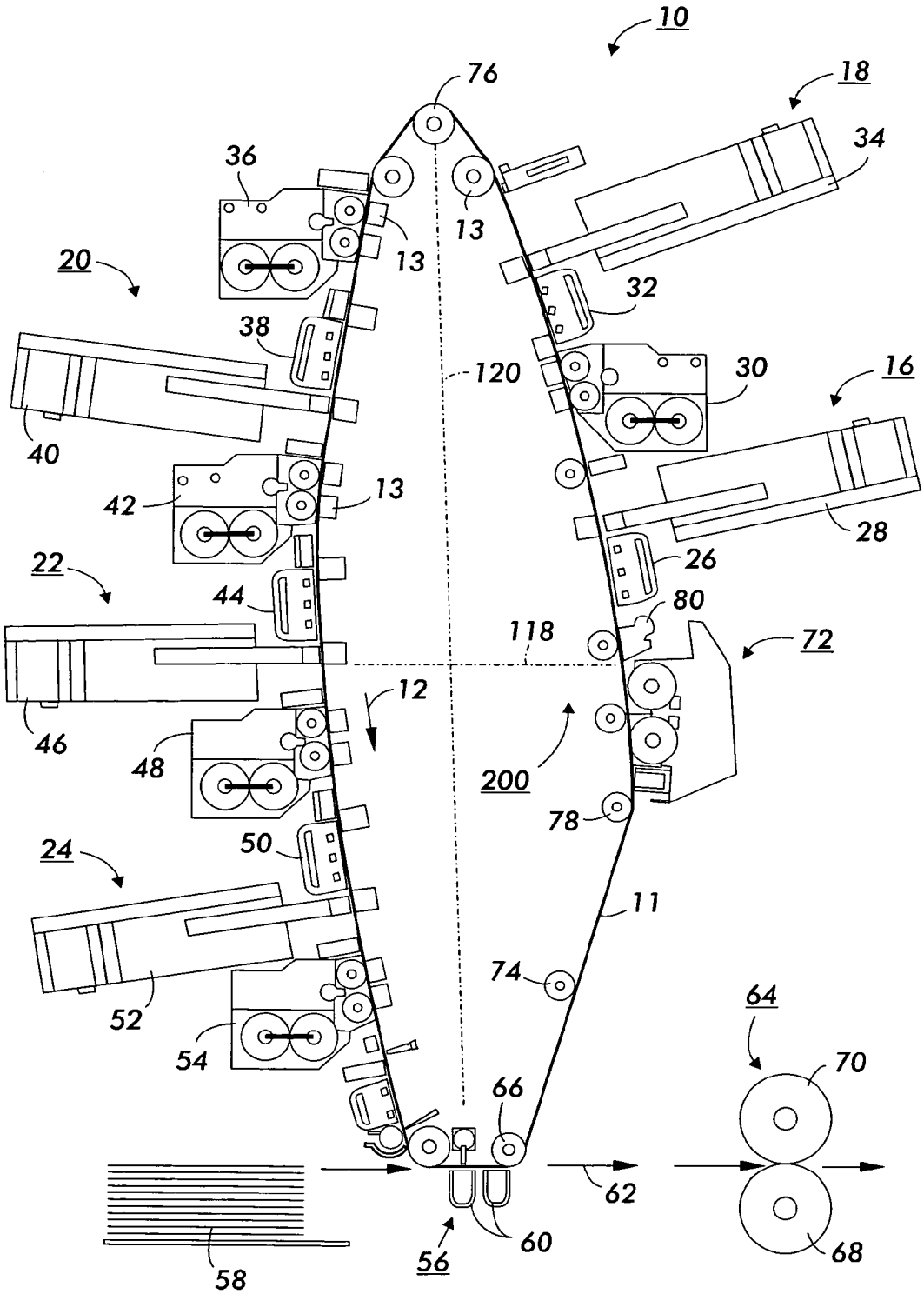
FIG. 1 is a partial schematic view of a xerographic printing apparatus including a belt supporting and drive assembly for use with the present invention.
Figure 2:
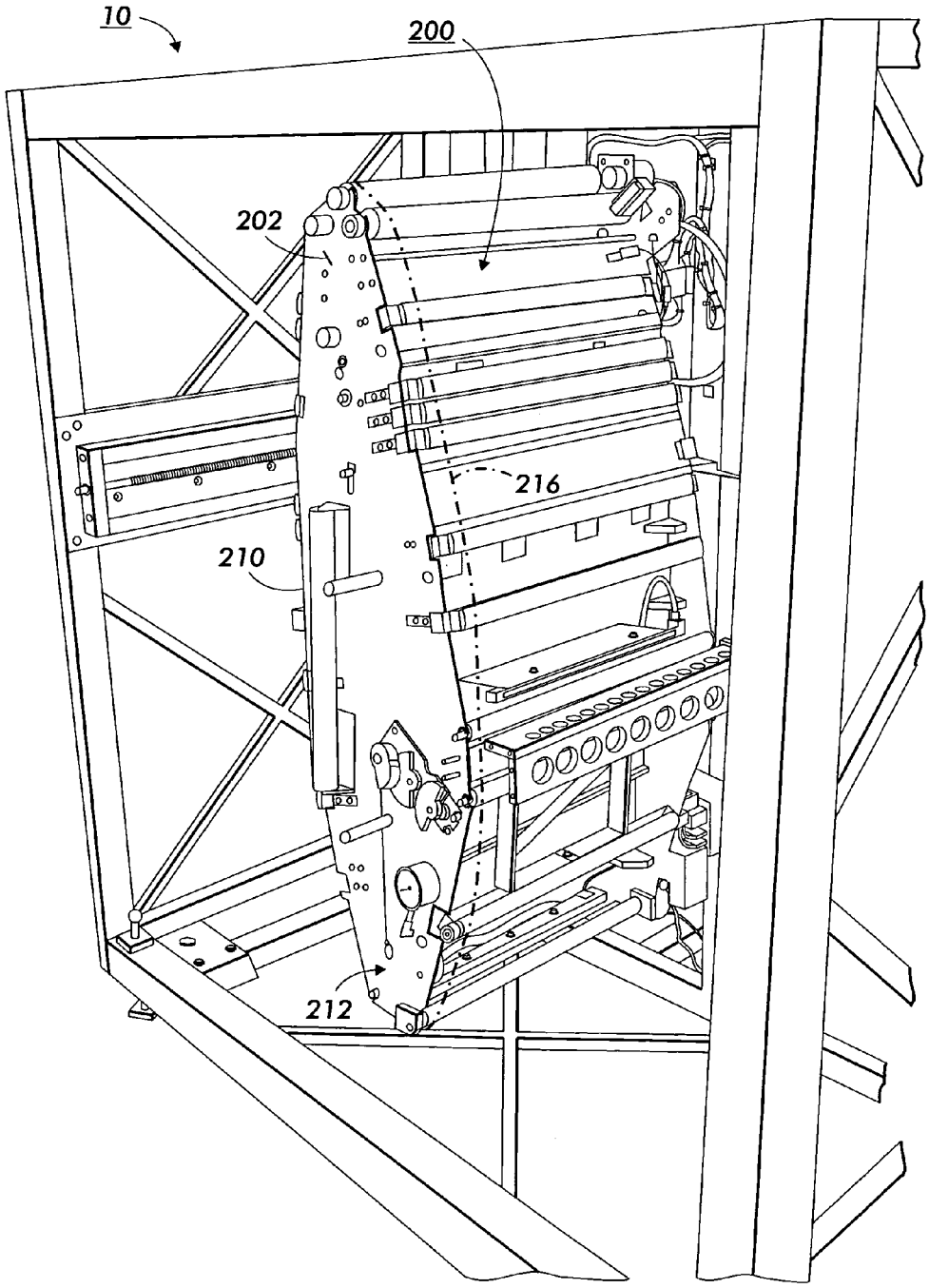
FIG. 2 is a partial perspective view of the frame of the printing apparatus of FIG. 1 showing the belt support and drive assembly without photoconductive belt loaded thereon.

With reference to FIG. 1, there is shown a single pass multi-color xerographic printing machine 10, for example, that employs a flimsy continuous photoconductive imaging belt 11 as is well known. For operation, the belt 11 is mounted onto and driven by a belt support and drive assembly or belt module 200 that includes a series of rollers 74 and 76, or bars, 13. The belt support and drive assembly 200 includes a front end 202 that includes a first perimeter 210 having a first shape 212, for example, an elliptical or oval shape as shown. Usually the photoconductive belt 11 assumes that same given first shape 212 when it is mounted onto the belt module or belt support and drive assembly 200. In one application as illustrated, the module 200 and the photoconductive belt 11 as mounted, each have a major axis 120 and a minor axis 118. The major and minor axes are perpendicular to one another, thus giving each of them the elliptical shape 212. The major axis 120 is substantially parallel to the gravitational vector and arranged in a substantially vertical orientation. The minor axis 118 is substantially perpendicular to the gravitational vector and arranged in a substantially horizontal direction.

In operation of the single pass multi-color xerographic printing machine 10, the photoconductive belt 11 advances in the direction of arrow 12 to move successive portions of its external surface sequentially beneath the various xerographic processing stations disposed about the path of movement thereof within the printing machine 10. Initially, belt 11 passes through charging station 16 that includes a charging device such as a corona generator 26 that charges the exterior surface of photoconductive belt 11 to a relatively high, and substantially uniform potential.

After the exterior surface of photoconductive belt 11 is charged, the charged portion thereof advances to an exposure station that includes a an exposure device such as a raster output scanner (ROS) 28, that image-wise illuminates the charged portion of the exterior surface of photoconductive belt 11 to record a first electrostatic latent image thereon. Alternatively, a light emitting diode (LED) may be used.

This first electrostatic latent image is developed at a development station by developer unit 30 that deposits charged toner particles of a selected first color on the first electrostatic latent image. After the toner image has been developed as such on the exterior surface of photoconductive belt 11, belt 11 continues to advance in the direction of arrow 12 to a recharging station 18.

Recharging station 18 includes a recharging device and an exposure device. The charging device for example is a corona generator 32 that recharges the exterior surface of photoconductive belt 11 to a relatively high, and substantially uniform potential. The exposure device, for example, a ROS 34, image-wise illuminates the charged portion of the exterior surface of photoconductive belt 11 selectively to record a second electrostatic latent image thereon. This second electrostatic latent image corresponds to the regions to be developed with for example with second color of toner particles. This second electrostatic latent image is now advanced to the next successive developer unit 36.

Developer unit 36 deposits the second color toner, for example magenta toner particles on the electrostatic latent image. In this way, a magenta toner powder image is formed on the exterior surface of photoconductive belt 11. After the magenta toner powder image has been developed on the exterior surface of photoconductive belt 11, photoconductive belt 11 continues to advance in the direction of arrow 12 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 11 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 11 to form a yellow toner powder image thereon. After the third electrostatic latent image has been developed with yellow toner, belt 11 advances in the direction of arrow 12 to the next image recording station 22.

Image recording station 22 includes a charging device and an exposure device. The charging device includes a corona generator 44, which charges the exterior surface of photoconductive belt 11 to a relatively high, substantially uniform potential. The exposure device includes ROS 46, which illuminates the charged portion of the exterior surface of photoconductive belt 11 to record a fourth electrostatic latent image for development with cyan toner particles. After the fourth electrostatic latent image is recorded on the exterior surface of photoconductive belt 11, photoconductive belt 11 advances this electrostatic latent image to the magenta developer unit 48.

Cyan developer unit 48 deposits magenta toner particles on the fourth electrostatic latent image. These toner particles may be partially in superimposed registration with the previously formed yellow powder image. After the cyan toner powder image is formed on the exterior surface of photoconductive belt 11, photoconductive belt 11 advances to the next image recording station 24.

Image recording station 24 includes a charging device and an exposure device. The charging device includes a corona generator 50 which charges the exterior surface of photoconductive belt 11 to a relatively high, substantially uniform potential. The exposure device includes ROS 52, which illuminates the charged portion of the exterior surface of photoconductive belt 11 to selectively discharge those portions of the charged exterior surface of photoconductive belt 11 which are to be developed with black toner particles. The fifth electrostatic latent image, to be developed with black toner particles, is advanced to black developer unit 54.

At black developer unit 54, black toner particles are deposited on the exterior surface of photoconductive belt 11. These black toner particles form a black toner powder image which may be partially or totally in superimposed registration with the previously formed yellow and magenta toner powder images. In this way, a multi-color toner powder image is formed on the exterior surface of photoconductive belt 11. Thereafter, photoconductive belt 11 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the back side of the paper. This attracts the developed multi-color toner image from the exterior surface of photoconductive belt 11 to the sheet of paper. Stripping axis roller 66 contacts the interior surface of photoconductive belt 11 and provides a sufficiently sharp bend thereat so that the beam strength of the advancing paper strips from photoconductive belt 11. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 11. The photoconductive belt 11 moves over isolation roller 78 which isolates the cleaning operation at cleaning station 72. At cleaning station 72, the residual toner particles are removed from photoconductive belt 11. The belt 11 then moves under spots blade 80 to also remove toner particles therefrom.

The large and long photoreceptor belt such as a 10-pitch belt, is very difficult to mount onto a belt module without causing wrinkles or damaging the belt by touching any parts of the module. The belt module for such a belt usually is a huge assembly of lots of xerographic elements that leave very little room for sliding the belt into its place. Attempts to load by sliding necessarily require that the photoreceptor belt take a shape that conforms to the shape of the module during the mounting attempt. This is ordinarily not possible because the photoreceptor belt is a thin flimsy device, about 125 microns in thickness.

Yet proper operation and maintenance of the xerographic printing machine 10 long term requires that the photoconductive belt 11 be replaced from time to time. Replacing the belt 11 involves removing an old and existing belt on the belt module 200 and then loading a new belt onto the belt module. As pointed out above, the photoconductive or photoreceptor belt 11 can be a large belt, such as an AMAT belt, and so will be too flexible and unwieldy for one person to handle safely during such loading without causing some damage to the belt. Any such damage of course will result in image quality defects. To prevent such damage, a belt loading apparatus 300 in accordance with the present invention can be used.

Figure 3:
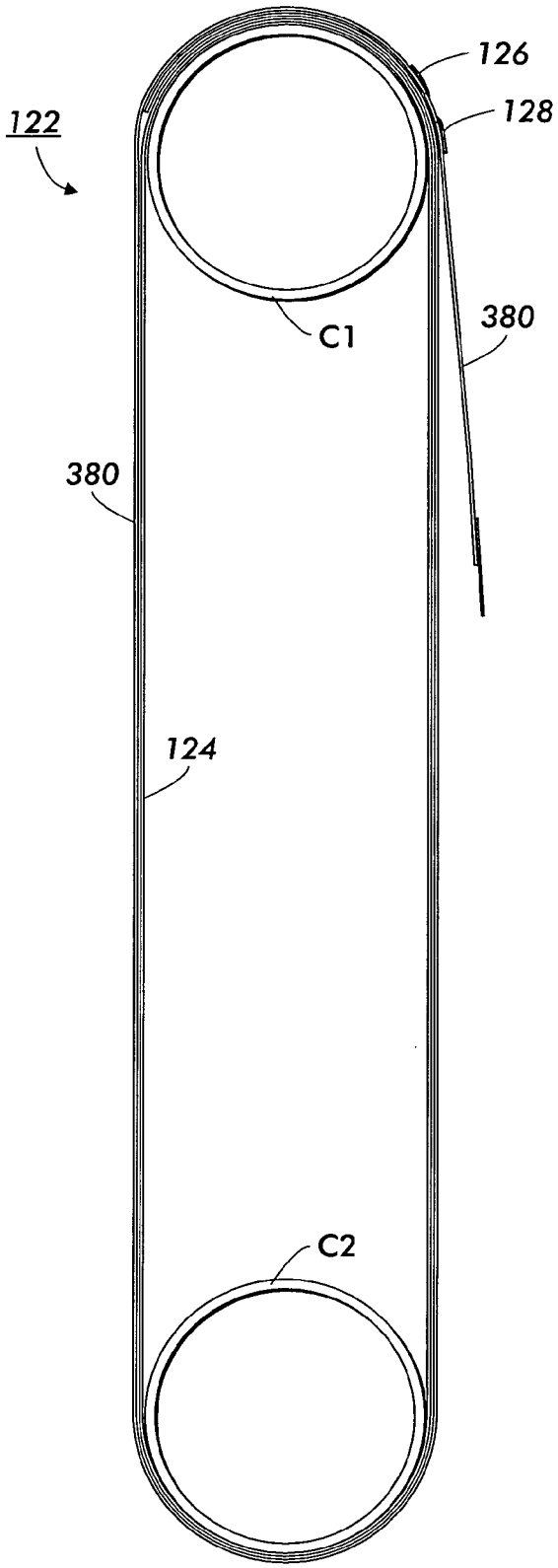
FIG. 3 is a schematic of a flimsy continuous belt such as a photoconductive belt, unwrapped and ready for loading onto a belt supporting and drive assembly.

Referring now to FIG. 3, there is illustrated a straight-down hanging wrapped or pre-protected loop 122 of the flimsy belt 11 unfolded from its packaged state as disclosed for example in pending and commonly owned U.S. application Ser. No. 10/625,192 filed Jul. 23, 2003. As disclosed therein, unfolding and dropping of the packaged loop 122 will free a third packaging core (not shown but which initially was external to the wrapped loop 122) to fall free, but leave other cores C1 and C2 inside the flexible belt loop 124. With the loop tacking adhesive tape 126, 128 still applied, the protective member 380 (to be described further below) is thus still intact as a protective loop 380 over the flexible belt loop 124. The two loops 124, 380 together (as the wrapped loop 122) can thus be moved and handled for mounting onto the belt loading apparatus 300 of the present invention, in preparation for loading onto the belt module 200 in accordance with the present invention.

Referring now to FIGS. 4–9, there is shown in accordance with the present invention, various embodiments of the belt loading apparatus 300 of the present invention. As shown, the belt loading apparatus 300 is suitable for mounting and positioning a flimsy continuous belt, such as the photoconductive belt 11, onto a belt support and drive assembly or belt module 200. The belt module 200 includes a vertical front end 202 having a first perimeter 210 defining a first shape 212. The first shape for example is elliptical. The belt loading apparatus 300 includes a wall member 310 defining a sleeve 320. The sleeve 320 includes an outer surface 330 having a total outer surface area A1, a first or front edge 334, and a second and opposite or back edge 336. The second edge 336 includes a second perimeter 340 that has a second shape 342. The second shape 342 of the second edge 336 is a mirror image of the first shape 212 of the belt support and drive assembly 200.

The belt loading apparatus 300 also includes friction reducing members 350 formed or embossed on the outer surface 330 of the sleeve 320, and having a typical height 1 to 10 mils, for temporarily supporting and spacing a flimsy continuous belt such as the belt 11 just before such belt is loaded onto the belt support and drive assembly 200. In order to reduce friction and the risk of electrostatic damage to the belt 11, the friction reducing members 350 each have a belt contact area 356 that are sized such that a sum total A2 of all such belt contact areas 356 of friction reducing members 350 is significantly less than the total outer surface area A1 of the sleeve 320. Each belt contact area of each of the friction reducing members has a convex curved profile as shown.

Figure 4:
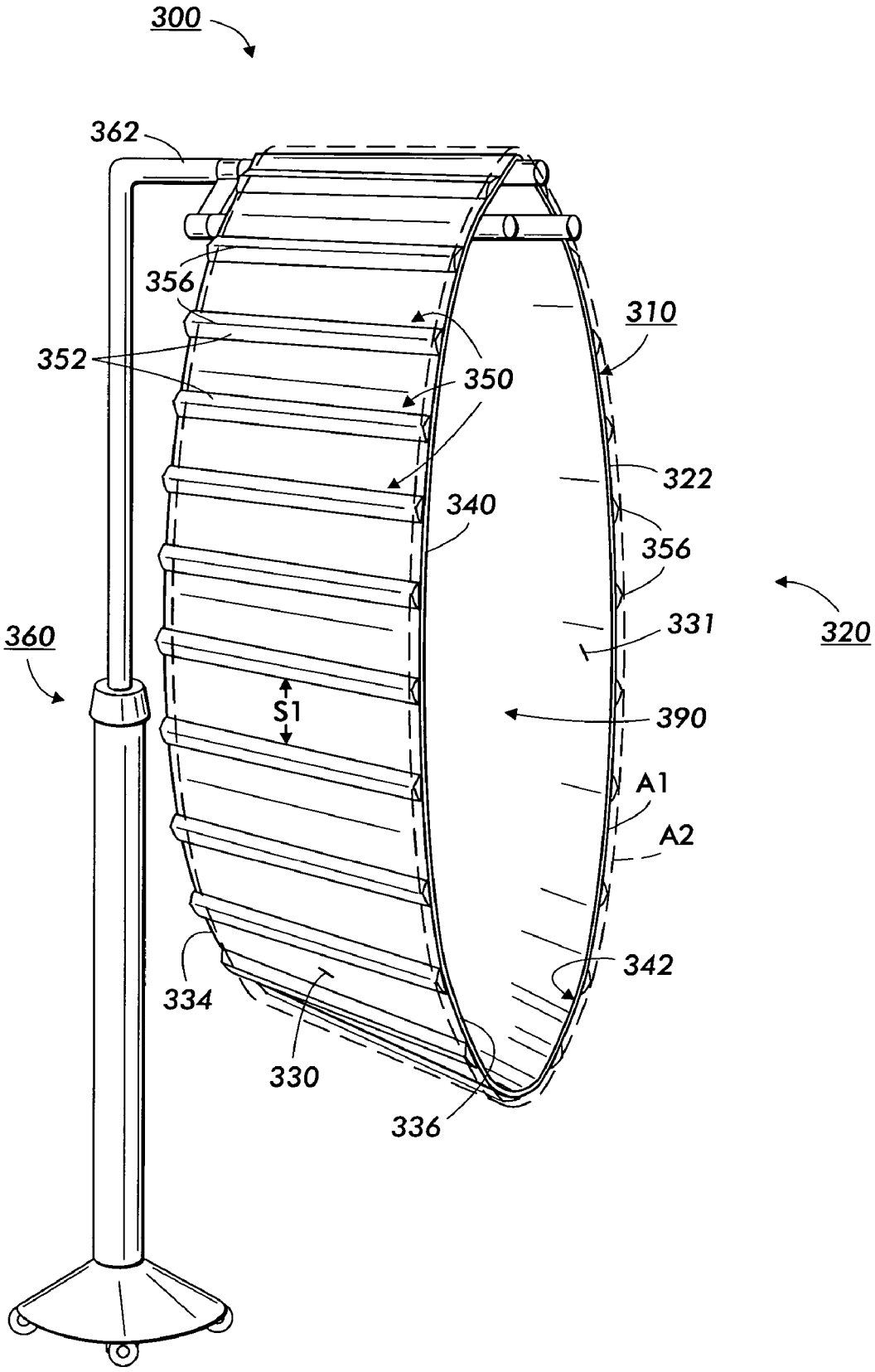
FIG. 4 is a perspective view of a first embodiment of the flimsy belt loading apparatus including ridges as friction reducing members in accordance with the present invention.
Figure 5:
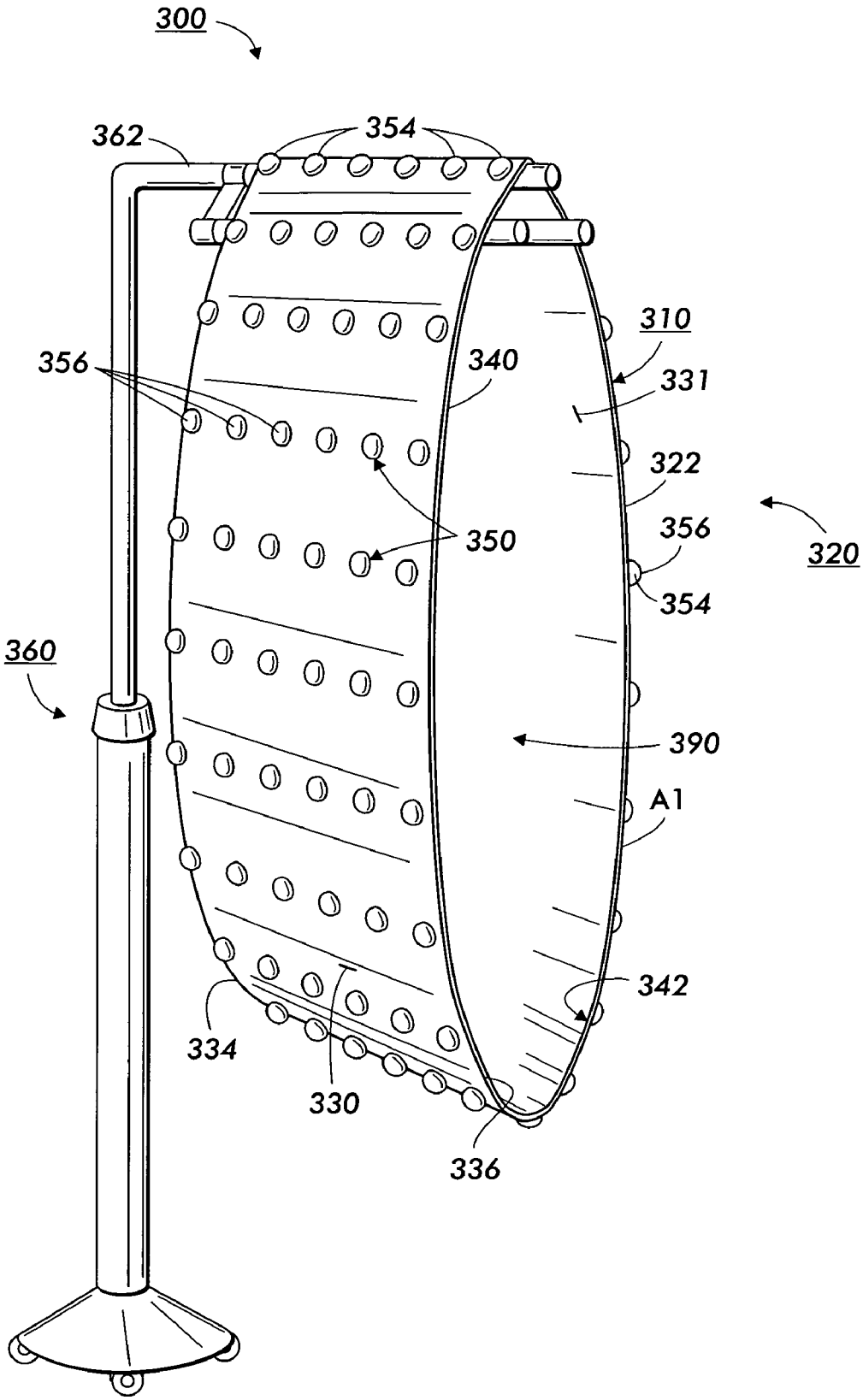
FIG. 5 is a perspective view of the first embodiment of the flimsy belt loading apparatus including isolated mounds as friction reducing members in accordance with the present invention.

The friction reducing members 350 are conductive so as to prevent tribo-electric charging between them and the temporarily supported flimsy continuous belt 11. As illustrated in FIGS. 4 and 5, each of the friction reducing members 350 whether as a ridge 352 or mound 354, comprises or is like a portion of a generally circular projection as shown above the outer surface 330 of the sleeve 320

In a first version, the generally circular projection is a ridge 352 extending from the at least one or first edge 334 to a first direction opposite the at least one edge 334, and spaced apart a distance S1 in an orthogonal direction from adjacent such ridges 352.

In another version, the generally circular project is a mound 354, for example embossed, and having a circular diameter at the base, and forming part of an array of such mounds 354 (as shown) spaced apart, one from another, and extending in the first direction from the at least one or first edge 334 to a point opposite such edge. The array of such mounds 354 is spaced apart from adjacent such arrays in the generally orthogonal direction relative to the first edge-to-edge direction. A typical circular diameter at the base of the embossed area can be a few millimeters to centimeters and the heights at the center from 25 microns to 500 microns. Since the photoreceptor will come in contact with the sleeve 320 only at the peak or contact area 356 of the friction reducing member 350, the total contact area A2 will be reduced and thereby the friction will be reduced.

In a first embodiment as illustrated in FIGS. 4 and 5, the sleeve 320 is a semi-solid or semi-rigid belt 322 having a thickness within a range of 5 mils to 100 mils for providing rigidity. The semi-rigid solid belt is a nickel belt. Alternatively, the semi-rigid belt can be made of a plastic material such as polyethylene, polycarbonates or polyimide films.

Because the sleeve 320 is to be inserted inside the photoreceptor belt 11 for supporting it during loading, the sleeve 320 therefore is required to have very good rigidity.

Materials satisfying this requirement include nickel from 5 to 10 mils in thickness, and plastic selected from among polyetheretherketone, polyimide, polyetherimide, polyethersulfone, polysulfone, polymethylpentene, polyvinylidene flouride, ehylene-chloroytifluoroethylene, polycarbonate, biaxially oriented polyvinyl flouride, biaxially oriented polyethylene terephthalate (PET), biaxially oriented polyethylene naphthalate (PEN), and the like. The sleeve belt 322 should have a outer circumference about 10 mm to about 10 cm smaller than that of the photoreceptor belt 11 in order to ease inserting it inside the photoreceptor belt loop 122. The plastic support, or sleeve belt 322 as such should have a thickness of between about 5 and about 100 mils in order to provide rigidity. The plastic material for example is a white opaque polyester film available under a trade name of Melinex 359 (trade name of ICI, Inc.)

Figure 6:
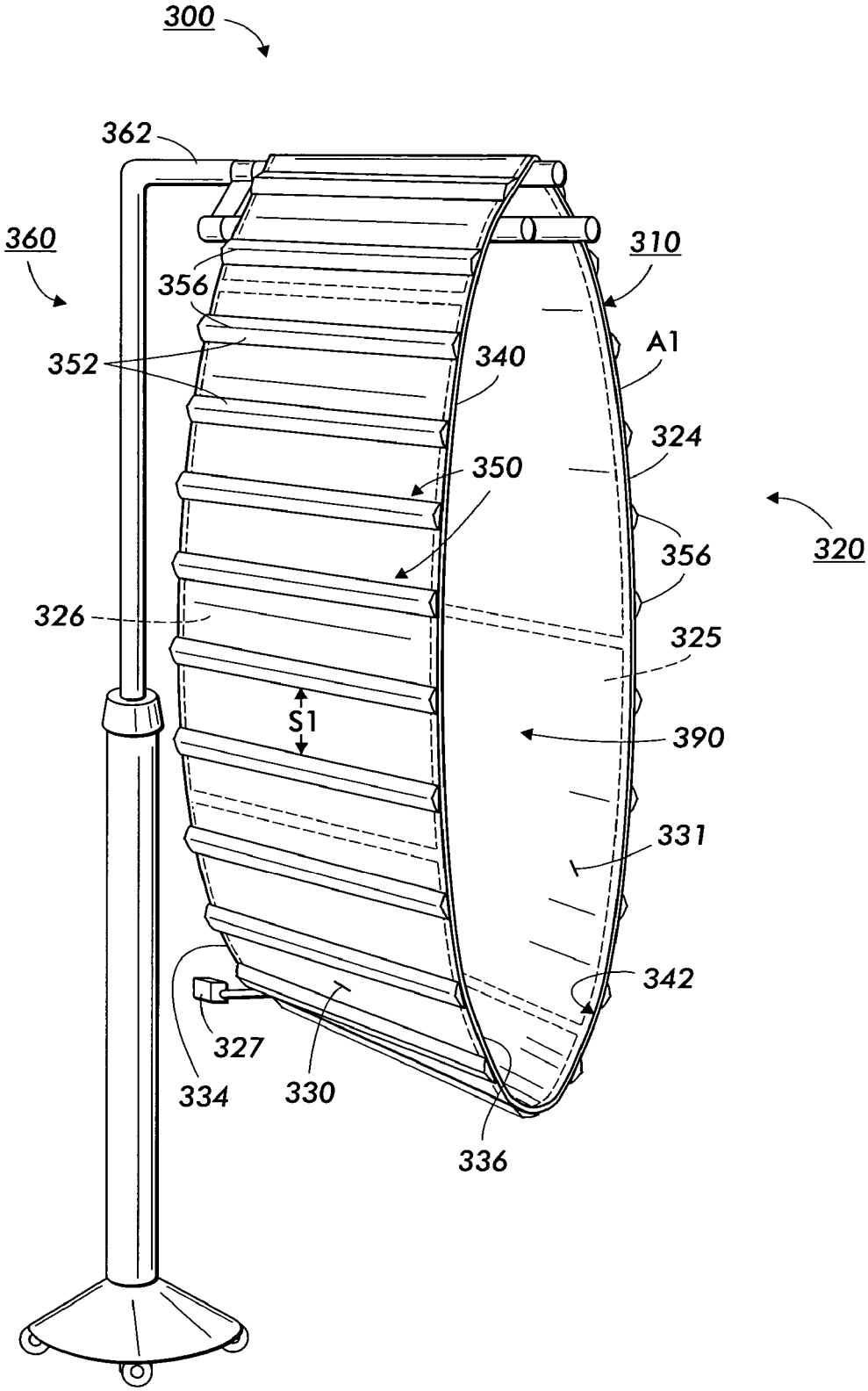
FIG. 6 is a perspective view of a pneumatic sleeve, second embodiment of the flimsy belt loading apparatus including ridges as friction reducing members in accordance with the present invention.
Figure 7:
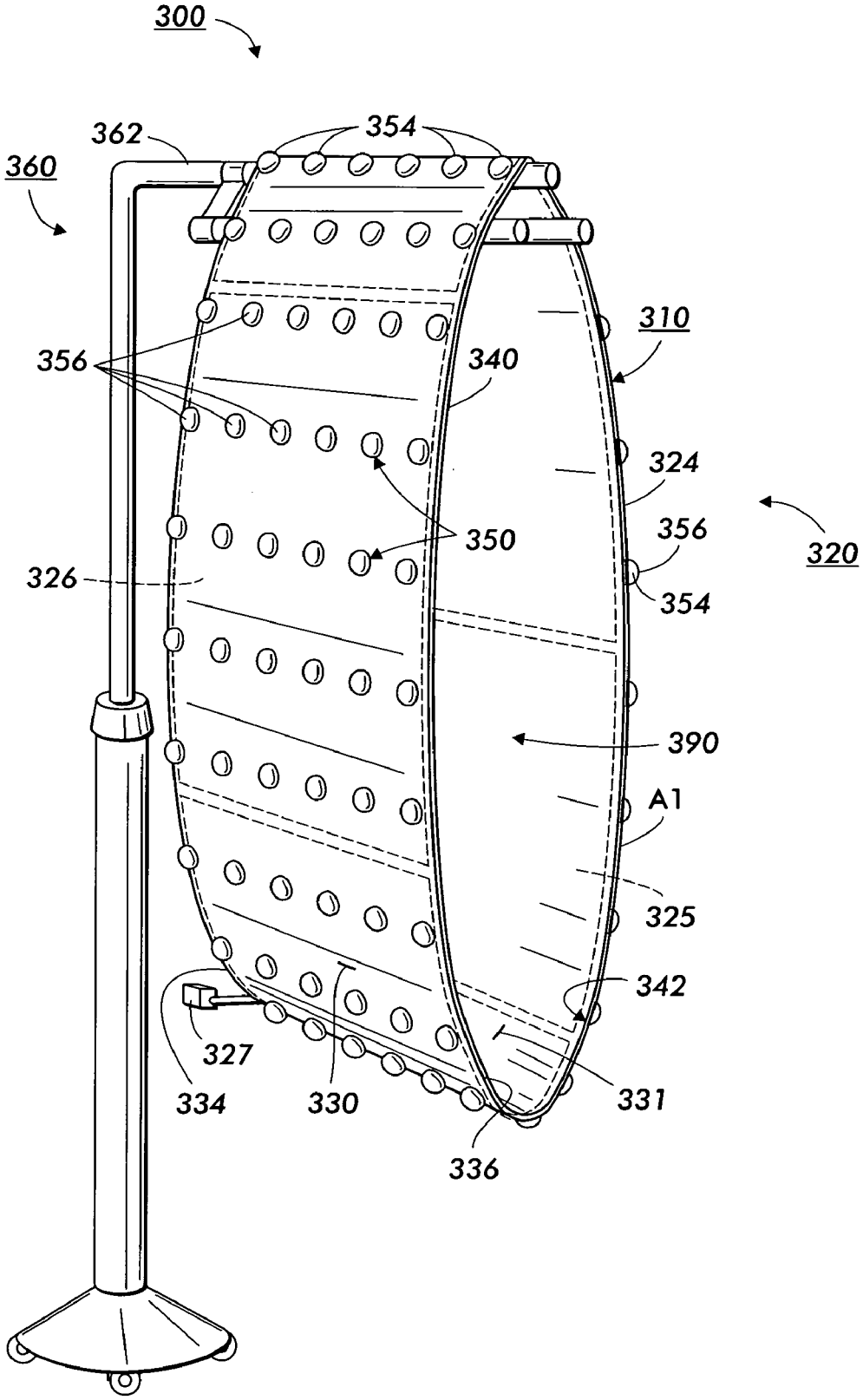
FIG. 7 is a perspective view of the pneumatic sleeve, second embodiment of the flimsy belt loading apparatus including isolated mounds as friction reducing members in accordance with the present invention.

In a second embodiment as illustrated in FIGS. 6 and 7, the sleeve 320 is an inflatable pneumatic device 324. The inflatable pneumatic device 324 for example includes internal baffles 325 and 326 for producing a desired shape, such as the second shape 342, and a desired rigidity thereto. For ease of use, the inflatable pneumatic device 324 includes a valve member 327 for example, thus making it deflatable so as to collapse it into a relatively smaller shape and form for carrying about. Thus the invention consists of the pneumatic sleeve 324 in the shape of an air bag whose cross section has a shape conforming to that of the belt module 200.

A technical representative can fill the air bag or sleeve 320 using the valve device 327 and exhaust air from a standard vacuum cleaner for example. The belt 11 is taken out of its shipping container, unwrapped and slipped over the inflated sleeve 320.

In both cases, the sleeve 320 and the belt 11 on it, can then be juxtaposed and aligned with the front end 202 of the module 200 so that the belt 11 can be slid off of the sleeve 320 and onto the belt module 200. The valve device 327 can be a simple flapper style check valve to match the vacuum cleaner hose. The second and opposite edge 336 of the air bag or pneumatic device 324 is tapered relative to the first edge 334 (edge that aligns against module), and the internal baffles 325, 326 are provided in order for the device 324 when inflated to maintain the desired second shape 342.

According to one aspect of the present invention, the sleeve 320, whether as the belt 322 or pneumatic device or air bag 324, can be pre-loaded first onto a movable and adjustable support stand 360, then the flimsy belt 11 placed over it, for aligning against the front end 202 of the belt module 200. When pre-loading the sleeve 320 and belt 11 onto the support stand 360, they are loaded front or first edge 334 first onto extending arms 362 of the stand 360. In this manner, when the assembly is aligned to the front end 202 of the module 200, the belt 11 is then pushed or slid off second or back edge 336 first off of the sleeve and onto the belt module 200.

As described above, in order for this to work, the sleeve 320 includes an outer surface 330 having a total outer surface area A1, a first edge 334 and a second and opposite edge 336. The second edge 336 has a second perimeter 340 defining the second shape 342. The second shape 342 of the second edge 336 is a mirror image of the first shape 212 of the belt support and drive assembly or belt module 200 in order to facilitate alignment and loading of the belt 11 from the sleeve 320 onto the module 200.

Figure 8:
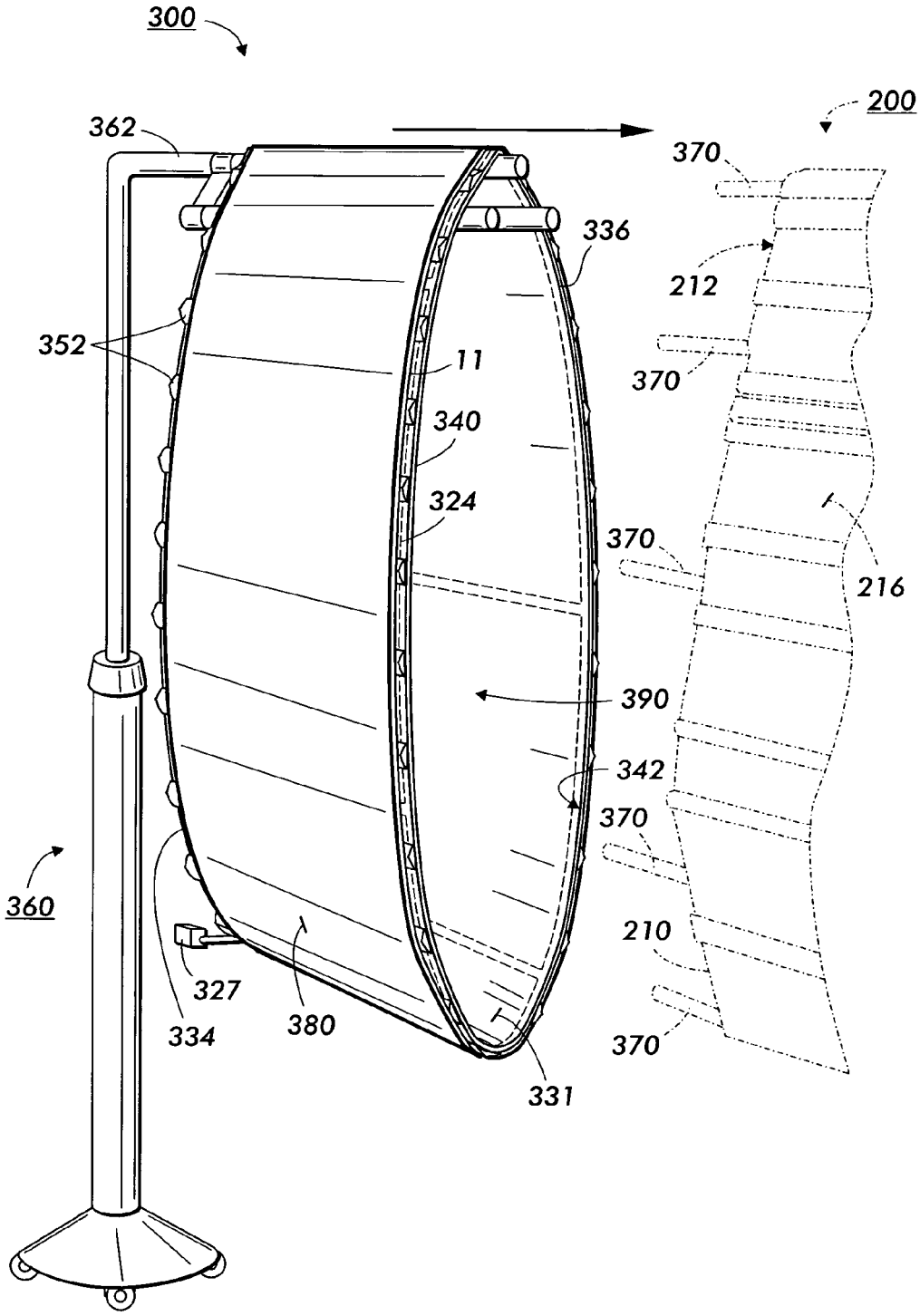
FIG. 8 is a perspective view of the pneumatic sleeve embodiment of the flimsy belt loading apparatus showing the flimsy belt and a protective member mounted thereon ready for loading onto the belt module.
Figure 9:
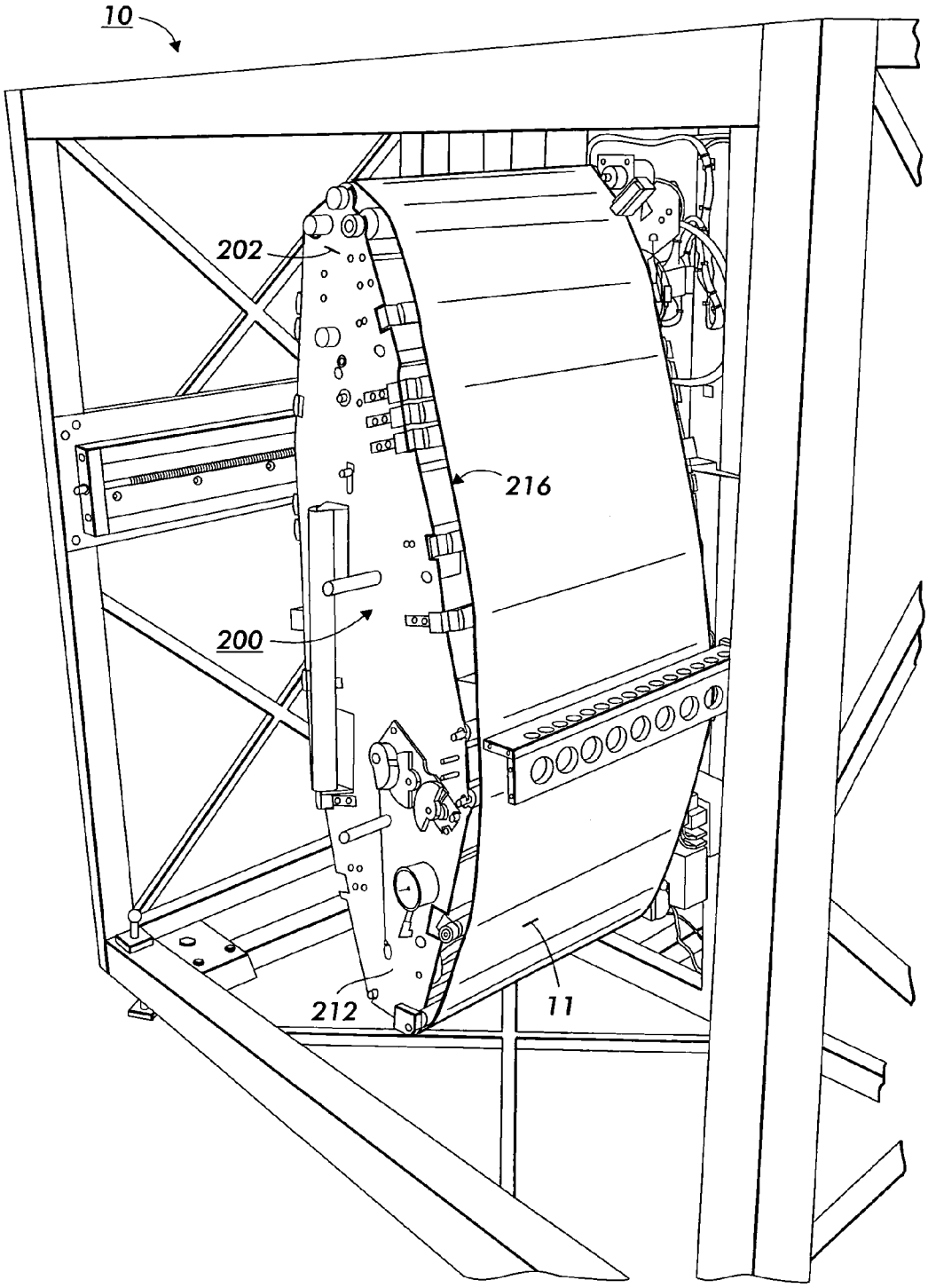
FIG. 9 is a partial perspective view of the frame of the printing apparatus of FIG. 1 showing the belt module with the flimsy, photoconductive belt loaded thereon in accordance with the present invention.

Alternatively, as illustrated in FIG. 8, the sleeve 320 can be pre-loaded first onto a stand 360, and then onto a set of removable dowel pins 370 that are mounted removably around the first perimeter 210 of the module 200. The removable dowel pins 370 may be mounted as such just inside of the belt path 216 of the belt module 200 for aligning the belt 11 when placed over it. Again, the flimsy belt 11 (with a protective member 380 thereover) can then be placed over the sleeve 320, in alignment with the front end 202 of the belt module 200. Thereafter, the belt 11 can finally be slid with little risk of damage from friction from the sleeve 320 onto the module itself. The dowel pins can then be pulled out of the module. Note that the sleeve 320 either as a belt 322 or a pneumatic device 324 has a second or back edge 336 perimeter 340 that defines the second shape 342 that is approximately a mirror image of the shape of the belt module 200.

In the second embodiment where the sleeve 320 is a pneumatic device 324, the belt 11 can be put over the pneumatic device or air pillow 324 before the air pillow is inflated. After that the air pillow or pneumatic device 324 can then be inflated so that the belt 11 acquires the same shape as that of the pneumatic device, and so that the belt 11 can slide easily over the pneumatic device onto the belt module 200. The assembly of the air bag or pillow 324 and belt 11 can then be put on the dowel pins 370. The belt is slid off of the sleeve 320 onto the belt module 200. Air pressure in the air bag or pillow 324 can be adjusted in order to make the sliding of the belt 11 easier. The air bag or pillow 324 is then removed from the dowel pins 370, deflated and put away for reuse. The dowel pins 370 can then also be removed and stored away.

As a further alternative to aligning the sleeve 320 and belt 11 on it to the machine module 200, VELCRO™ strips (not shown) may be provided around the perimeter 210 of the front end 202 of the belt module 200, and around the perimeter 340 of the back end or second edge 336 of the sleeve 320 for temporary attachment of the two. In the case of the second embodiment, after inflating the pneumatic device or air pillow, it can then be attached to the belt module with the help of such VELCRO™ strips. Thereafter, the procedure is the same as above.

Referring now to FIGS. 3 and 8, the belt loading apparatus 300 may also include a protective device 380 having a circumference greater than a circumference of the flimsy continuous belt 11, thus allowing the protective device 380 to slidably fit over the flimsy continuous belt 11, even when supported on the sleeve 320. The protective device 380 for example can be black photo paper or it can be a plastic belt having a thickness that is less than the thickness of the sleeve 320. When the protective device 380 is a belt, such belt should be made of a plastic material selected out of the same materials like the support belt or sleeve 320, but it should be thinner in thickness, and be within a range of from about 5 to about 20-mil thick. The circumference of the protective belt should be from about 20 mm to 10 cm larger than that of the photoreceptor belt 11.

For the same reason, both support sleeve 320 and protective belt or device 380 may be conductive in order to avoid tribo-electrical charging. Each may also have a lower surface energy of less than 35 dynes/cm than the photoreceptor belt 11 in order to ease insertion as well as removal of these belts from the photoreceptor belt 11 after completion of its loading process onto the machine belt module 200.

Alternatively, the belt loading apparatus 300 may additionally include (a) a holding cavity 390 located within the sleeve 320 and adjoining an inner surface 331 of the sleeve 320 for temporarily holding the belt support and drive assembly 200; (b) at least one opening located at the at least one, back edge 336 and opening into the holding cavity 390 for allowing movement of the sleeve 320 onto and back out over the belt support and drive assembly or module 200. The holding cavity 390 as such has a size and the second shape 342 for slidably fitting over the belt support and drive assembly 200. The sleeve 320 when defining the holding cavity 390 has an external diameter that is about 10 mm to 10 cm less than an inner diameter of the flimsy continuous belt 11 in order to allow the belt 11 to fit over the sleeve 320. The sleeve 320 thus may include an opposite edge 334, and a second opening located at the first edge.

The first edge 334 and the second edge 336 have a first diameter and a second diameter respectively, and the first diameter is slightly greater than the second diameter for producing a tapered profile in the sleeve from the first edge 334 towards the first edge 334.

The belt module is usually provided with an adjustable element such as a roller or a backer bar that is relaxed in order to loosen or tighten the tension on the belt. Once the belt is loaded onto the module 200 as such, the adjustable roller or backer bar can then be tightened. The belt loading apparatus 300 of the present invention thus will eliminate the problem of photoreceptor belt sticking to a conventional smooth surface device such as the boot of the prior art.

It is, therefore, apparent that there has been provided in accordance with the present invention, a belt loading apparatus for loading a flimsy continuous belt onto a belt support and drive assembly including a vertical front end having a first shape and without damage to the belt. The belt loading apparatus includes a wall member defining a sleeve including an outer surface having a total outer surface area, a first edge and a second and opposite edge. The second edge has a vertical profile having a second shape such that the second shape of the second edge is a mirror image of the first shape of the belt support and drive assembly. The belt loading apparatus then includes friction reducing members formed on the outer surface of the sleeve for temporarily supporting and spacing a flimsy continuous belt to be loaded onto the belt support and drive assembly. The friction reducing members each have a belt contact area such that a sum total of belt contact areas of all the friction reducing members is significantly less than the total outer surface area of the sleeve.

While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A belt loading apparatus for loading a flimsy continuous belt without damage onto a belt support and drive assembly including a front end having a first perimeter defining a first shape, the belt loading apparatus comprising:

a) a wall member defining a sleeve including an outer surface having a total outer surface area, a first edge and a second and opposite edge, said second edge having a second perimeter defining a second shape, said second shape of said second perimeter of said sleeve being a mirror image of said first shape of said first perimeter of said belt support and drive assembly; and d) friction reducing members formed on said outer surface of said sleeve for temporarily supporting and spacing from said outer surface a flimsy continuous belt to be loaded onto said belt support and drive assembly, said friction reducing members each having a belt contact area such that a sum total of belt contact areas of all said friction reducing members is significantly less than said total outer surface area of said sleeve.

2. The belt loading apparatus of claim 1, wherein said sleeve comprises a semi-rigid belt.

3. The belt loading apparatus of claim 1, wherein each of said friction reducing members comprises a portion of a generally circular projection above said outer surface of said sleeve.

4. The belt loading apparatus of claim 3, wherein said portion of said generally circular projection comprises a ridge extending from said at least one edge to a direction opposite said at least one edge, and spaced apart in an orthogonal direction from adjacent such ridges.

5. The belt loading apparatus of claim 3, wherein said portion of said generally circular project comprises a mound forming part of an array of such mounds spaced apart from one another and extending in a direction from said at least one edge to a point opposite said at least one edge.

6. The belt loading apparatus of claim 5 wherein said direction is a first direction and said array of such mounds is spaced apart from adjacent such array in an orthogonal direction relative to said first direction.

7. The belt loading apparatus of claim 2, wherein said semi-rigid belt has a thickness T1 within a range of 5 mils to 100 mils.

8. The belt loading apparatus of claim 7, wherein said semi-rigid belt is a nickel belt.

9. The belt loading apparatus of claim 7, wherein said semi-rigid belt is made of a plastic material.

10. The belt loading apparatus of claim 9 wherein said plastic belt is made plastic material selected from among polyetheretherketone, polyimide, polyetherimide, polyethersulfone, polysulfone, polymethylpentene, polyvinylidene flouride, ehylene-chloroytifluoroethylene, polycarbonate, biaxially oriented polyvinyl flouride, biaxially oriented polyethylene terephthalate, and biaxially oriented polyethylene naphthalate.

11. The belt loading apparatus of claim 9, wherein said plastic material is a white opaque polyester film.

12. The belt loading apparatus of claim 1, wherein said friction reducing members are conductive for preventing tribo-electric charging between them and said flimsy continuous belt.

13. The belt loading apparatus of claim 1 wherein said sleeve comprises an inflatable pneumatic device.

14. The belt loading apparatus of claim 1, including a protective device for placing over said flimsy continuous belt, said protective device having a circumference greater than a circumference of said flimsy continuous belt for slidably fitting over said flimsy continuous belt when supported on said sleeve.

15. The belt loading apparatus of claim 14, wherein said inflated pneumatic device includes internal baffles for producing a desired shape and desired rigidity thereto after inflation.

16. The belt loading apparatus of claim 14, wherein said inflated pneumatic device is deflatable so as to collapse it into a relatively smaller shape and form for storage.

17. The belt loading apparatus of claim 1, wherein said flimsy continuous belt is an imageable photoconductive member having an outer imaging surface for use in a xerographic image producing machine.

18. The belt loading apparatus of claim 17, wherein said protective device comprises black photo paper.

19. The belt loading apparatus of claim 17, wherein said protective device comprises a plastic belt having a thickness T2 less than a thickness T1 of said sleeve.

20. The belt loading apparatus of claim 1, wherein each said belt contact area of each of said friction reducing members has a convex curved profile.

21. A belt loading apparatus for loading a flimsy continuous belt onto a belt support and drive assembly, the belt loading apparatus comprising:

a) a wall member defining a sleeve including an inner surface, and an outer surface having a total outer surface area and at least one edge;

b) a holding cavity located within said sleeve and adjoining said inner surface for temporarily holding said belt support and drive assembly;

c) at least one opening located at said at least one edge and opening into said holding cavity for allowing movement of said sleeve onto and back over said belt support and drive assembly; and d) friction reducing members on said outer surface for temporarily supporting and spacing a flimsy continuous belt to be loaded onto said belt support and drive assembly, said friction reducing members each having a belt contact area such that a total of all said belt contact areas is significantly less than said total outer surface area of said sleeve.

22. The belt loading apparatus of claim 21, wherein said holding cavity has a size and a shape for slidably fitting over said drive assembly for said flimsy continuous belt.

23. The belt loading apparatus of claim 21, wherein said sleeve when defining said holding cavity as an external perimeter about 10 mm to 10 cm less than an inner circumference of said flimsy continuous belt.

24. The belt loading of claim 21, wherein said sleeve includes another edge opposite said at least one edge, and a second opening located at said another edge.

25. The belt loading apparatus of claim 24, wherein said at least one edge and said second edge have a first diameter and a second diameter respectively, and said first diameter is slightly greater than said second diameter for producing a tapered profile in said sleeve for said another edge towards said at last one edge.

* * * * *